United States Patent [19]

Hayes et al.

[11] Patent Number: 4,982,588

[45] Date of Patent: Jan. 8, 1991

[54] ELECTRIC HEATER COIL FORMING AND TRANSPORTING APPARATUS

[75] Inventors: Lisa Hayes, Pomona, Calif.; Arthur Evans, Sherburne, N.Y.

[73] Assignee: Carrier Corporation, Syracuse, N.Y.

[21] Appl. No.: 454,478

[22] Filed: Dec. 21, 1989

[51] Int. Cl.[5] ..... B21F 3/02; B21F 35/00

[52] U.S. Cl. ..... 72/134; 72/135

[58] Field of Search ..... 72/133, 134, 135, 137, 72/422, 426; 29/173; 140/89, 92.9, 103; 198/418.6; 414/415, 745.7

[56] References Cited

U.S. PATENT DOCUMENTS

| | | | |
|---|---|---|---|
| 2,254,525 | 9/1941 | Hathaway et al. | 140/92.9 |
| 2,260,054 | 10/1941 | Platt | 140/89 |
| 3,585,833 | 6/1971 | Carraher et al. | 72/256 |
| 3,848,725 | 11/1974 | Toby | 198/418.6 |
| 4,147,048 | 4/1979 | Herckelbout | 72/137 |
| 4,236,397 | 12/1980 | Lange | 72/137 |

FOREIGN PATENT DOCUMENTS

| | | | |
|---|---|---|---|
| 2839394 | 1/1980 | Fed. Rep. of Germany | 140/89 |

*Primary Examiner*—E. Michael Combs

[57] ABSTRACT

A method and apparatus for forming an electric resistance heating coil of desired resistance that involves forming a helical coil and supporting the helical coil during forming in a vibrating through to prevent compression of the forming coil.

3 Claims, 2 Drawing Sheets

ELECTRIC HEATER COIL FORMING AND TRANSPORTING APPARATUS

BACKGROUND OF THE INVENTION

This invention relates generally to electric resistance heating coils, and more particularly to a method and apparatus for forming lengths of coils of desired dimensions and resistance and transferring the formed coils to a first folding station. During manufacture, electrical resistance space heating assemblies of the type employing a coiled resistance element require various forming, moving, manipulating, and checking steps. Straight wire is formed into a helical coil, configured into a desired shape, secured to an insulated support rack, lugged with electrical connectors, and inspected for proper insulation and resistance characteristics. Commonly assigned U.S. Pat. No. 4,528,441 discloses different insulator designs and a scheme for manually securing the coil to the insulators. The scheme, however, was only suited for hand assembly and required manual manipulation for each attachment as the coil was wrapped around the support rack and the insulators deformed the coil to achieve attachment. Commonly assigned U.S. Pat. Nos. 4,807,488 and 4,827,602 disclose a method and apparatus for automatically installing a coiled heater element onto insulators. To date, however, there has been no equipment or apparatus which permits the efficient forming, moving, manipulating and checking to be done efficiently and automatically without damage to the assembly. In moving and manipulating coils by hand, there is a potential for misalignment of the nichrome coil during forming and handling which would change the desired resistance of the coil and cause the completed coil assembly to be rejected. No apparatus has been proposed that permits forming a length of coil cut to a desired length, and transferring the formed coil to a folding station for folding the coil to the desired configuration prior to transferring the folded coil to an automatic rack assembly fixture.

Coils have been formed with a desired diameter and pitch using wire of a known diameter to form an electrical coil of required resistance. However, as the formed coil is discharged from the coil winder, frictional forces, e.g. the friction of the coil moving across a support table, inhibit proper movement of the coil and cause the diameter or length to vary from desired values and cause the coil to compress whereby adjacent winding of the coil could contact each other and short out a portion of the coil. After the coil winder has formed a coil, the formed coil is manually moved to a folding station where an operator tries to center the coil length in the folding apparatus. After the coil is folded it is again manually moved to a coil/rack assembly station to fix the coil to the insulators of a rack.

Thus, there is a clear need for an apparatus and method for forming a coil of a desired length and transferring the formed coil to a first folding station without damaging the coil.

SUMMARY OF THE INVENTION

It is an object of the present invention to manufacture electrical resistance heating coils of desired length, diameter, and resistance while avoiding the draw backs of the prior art.

It is another object of the present invention to provide a method and apparatus which will locate a coil of desired diameter, length, and resistance on a vibrating support table to reduce friction between the support table and the forming coil.

It is still a further object of the present invention to provide a means for transporting and centering the formed coil in a second work station.

It is a further object of this invention to provide a method and apparatus which will accommodate coils of different diameters, pitch, length and wire size.

These and other objects of the present invention are obtained by means of vibrating support table or trough for receiving a coil of desired length as it is being formed, thus reducing friction between the forming coil and support table, and centering the formed coil on the support table for transfer to an endless conveyor which transfers the centered coil to a first folding station.

The various features of novelty which characterize the invention are pointed out with particularity in the claims annexed to and forming a part of the specification. For a better understanding of invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification and which reference numerals shown in the drawing designate like or corresponding parts throughout the same, and in which.

DESCRIPTION OF THE PREFERRED EMBODIMENTS

Figure 1:
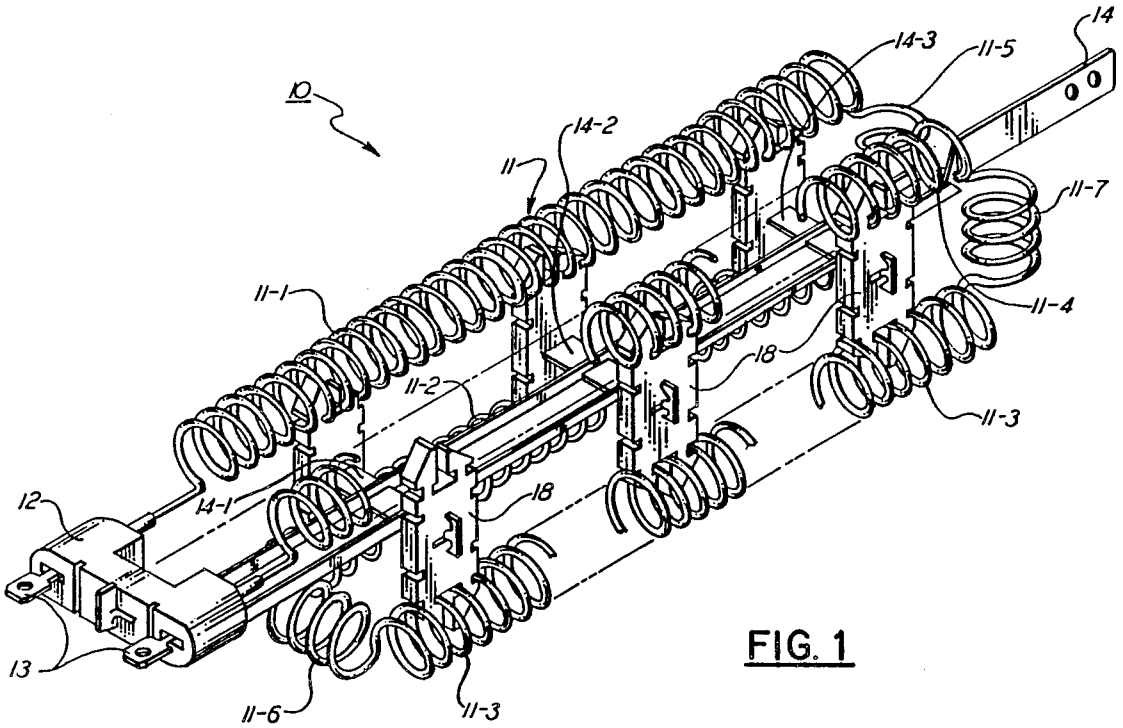
FIG. 1 is a perspective view of an assembled electrical resistance heating coil.

In FIG. 1, the numeral 10 generally designates an electric resistance heating coil. The wire coil 11 is made up of four (4) long legs or branches 11-1 through 11-4 connected by short legs or branches 11-5 through 11-7 and terminates in a spade lugs 13 separated by an insulator block 12. Coil 11 is supported on a tree or rack 14 by a plurality of ceramic insulators 18 which are located on the ends of branches 14-1 through 14-3 of the rack.

Figure 2:
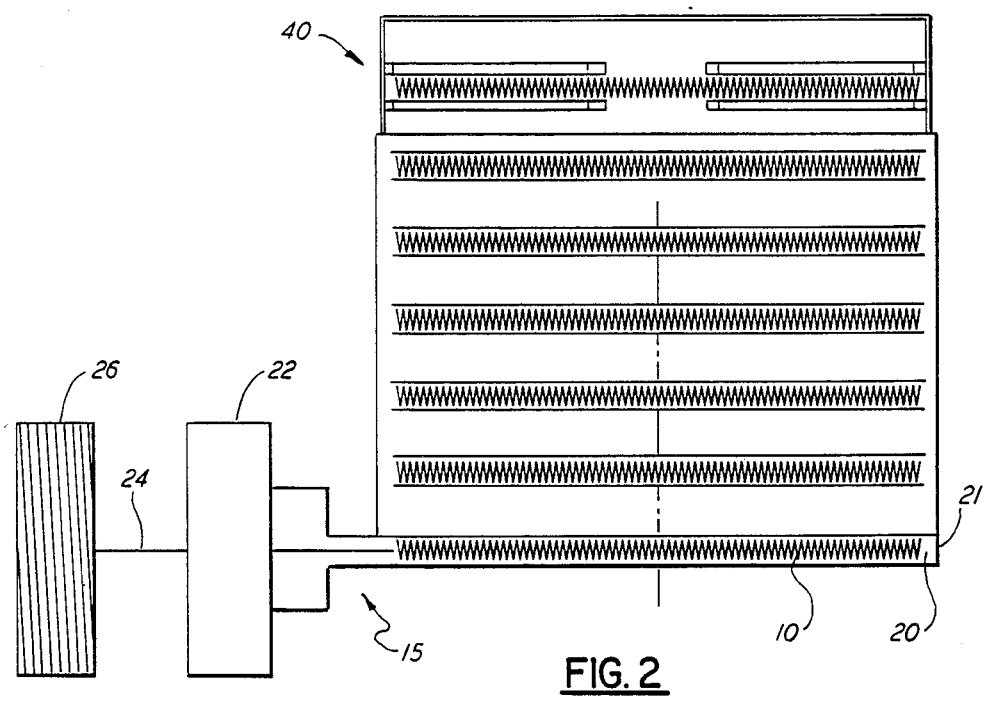
FIG. 2 is a schematic top plane view of forming a transferring apparatus according an embodiment of the present invention.
Figure 3:
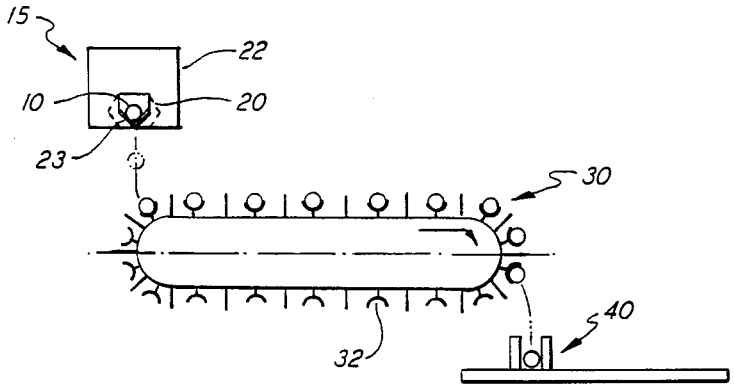
FIG. 3 is a schematic side elevation of the apparatus of FIG. 2.

In an electrical resistance space heating assembly the length, diameter, and pitch of the helically formed coil is critical in determining the desired resistance of the heating coil. In these heating assemblies adjacent coil windings must have proper spacing along the entire length of the coil, including the folds, to insure that the coil does not short-out and that both ends terminate in generally the same transverse plane. The sequential steps for the forming, moving and manipulating the coil 11 are illustrated in FIGS. 2-3. The key element in the forming process is a vibrating split receiving trough 20 which receives a singular electric resistance heating coil 10 along the length of the trough as it is formed and fed from coil winder 22.

The coil winder 22 is fed straight wire 24 from wire spool 26. The coil winder 22 receives the straight wire 24 and helically winds the wire into coils 10 of desired lengths by cutting the wire with a blade or the like (not shown) when the desired coil length is reached. In the prior art, when the helical coil was being formed and fed onto a support table or trough, frictional forces would cause the windings of the coil to change diameter or compress the windings of the coil such that adjacent coils were not spaced evenly along the length of the formed coil. The vibrating split receiving trough 20 reduces the frictional force between the trough 20 and the coil 10 to ensure a desired pitch, diameter and length of each coil. Further, the vibrating split receiving trough 20 prevents the formed coil 10 from compressing against the far wall 21 of the vibrating split receiving trough 20. The vibrating split receiving trough 20 is generally a U-shaped apparatus having a pair of side walls 23 which support a singular coil therein. As clearly shown in FIG. 3, the side walls 23 of the vibrating split receiving trough 20 move with respect to each other at the lower portion of the walls 23 to allow the trough to open and close about a formed coil 10 so that the coil can be transferred to endless belt conveyor 30. As the endless belt conveyor 30 moves in the direction of the arrow, each formed coil 10 is moved to and deposited in folding station 40. Conveyor 30 has a plurality of supporting members or saddles 32 for receiving and transporting each coil 10 between the vibrating split receiving trough 20 and the forming station 40. The saddles 32 prevent the formed coils from moving both longitudinally and transverse to the direction of movement of the conveyor.

FIG. 3 represents, in a schematic fashion, a technique for forming and moving an electrical resistance heating coil 10 of desired dimensions from a forming station 15 to a folding station 40. The coil winder 22 forms the coil 10 and deposits the formed coil in the vibrating split receiving trough 20, which is vibrated by a motor means (not shown) in order that the coil 10 as it is being deposited in the trough 20 will not be held against the trough by a frictional force between said coil and said trough. After a coil 10 desired length is made, cut and in position in the vibrating trough 20, the sides of the trough open (as shown in phantom in FIG. 3) and the coil 10 is moved to a position on saddle 32 on the endless conveyor 30. Generally, as a formed coil 10 is deposited on one end of the conveyor 30 a previously formed coil, having been placed in a saddle 32, is removed from the other end of the conveyor 30 and moved into the folding station 40.

While a preferred embodiment of the present invention has been depicted and described, it would be appreciated by those skilled in the art that many modifications, substitutions, and changes, for example, moving a coil from the conveyor to the forming station by way of a frictionless slide, may be made thereto without departing from the true spirit and scope of the invention.

What is claimed is:

1. An apparatus for forming and supporting an electric resistance heating coil at a coil forming station and then transferring the heating coil to a second station for performing a second manufacturing operation on the heating coil, the apparatus comprising:

a coil forming means for forming electric resistance wire into a helical coil of desired resistance whereby adjacent windings of said helical coil have a desired spacing along the entire length of said helical coil, a support means positioned adjacent the coil forming means for receiving and supporting a singular helical coil during forming of said helical coil having the desired spacing between adjacent windings and vibrating means for vibrating said support means as said singular coil is received thereon to reduce the frictional forces between said coil and said support means to provide free movement of said helical coil along a length of said support means whereby a helical coil of desired resistance and spacing between adjacent windings is formed.

2. The apparatus as set forth in claim 1 wherein said support means include a pair of pivotal wall members wherein said wall members open and close to support and discharge said singular helical coil therefrom.

3. The apparatus as set forth in claim 2 that further includes a conveying means for receiving said helical coil discharged from said support means for transport to the second station, said conveying means including a plurality of individual saddle means each for receiving and supporting a singular helical coil during transport to the second station.

* * * * *